US006315643B1

(12) United States Patent
Hiyama et al.

(10) Patent No.: US 6,315,643 B1
(45) Date of Patent: Nov. 13, 2001

(54) POLISHING APPARATUS AND METHOD

(75) Inventors: Hirokuni Hiyama, Tokyo; Seiyo Maekawa; Yutaka Wada, both of Kanagawa-ken, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/344,495

(22) Filed: Jun. 25, 1999

(30) Foreign Application Priority Data

Jun. 26, 1998 (JP) ..... 10-180731

(51) Int. Cl.[7] ..... B24B 1/00
(52) U.S. Cl. ..... 451/60; 451/446; 451/285
(58) Field of Search ..... 451/41, 60, 285, 451/286, 287, 290, 446

(56) References Cited

U.S. PATENT DOCUMENTS 5,647,792 * 7/1997 Katsuoka et al. ..... 451/285
5,651,725 * 7/1997 Kikuta et al. ..... 451/41
5,679,063 10/1997 Kimura et al. .
5,702,291 * 12/1997 Isobe ..... 451/41
5,709,593 * 1/1998 Guthrie et al. ..... 451/287
5,837,610 * 11/1998 Lee et al. ..... 438/692
5,857,898 1/1999 Hiyama et al. .
5,997,392 * 12/1999 Chamberlin et al. ..... 451/446
6,116,993 * 9/2000 Tanaka ..... 451/287

FOREIGN PATENT DOCUMENTS 8-197427 8/1996 (JP) .
9-29635 2/1997 (JP) .

* cited by examiner

*Primary Examiner*—Timothy V. Eley
*Assistant Examiner*—Dung Van Nguyen
(74) *Attorney, Agent, or Firm*—Wenderoth, Lind & Ponack, L.L.P.

(57) ABSTRACT

A polishing apparatus including a turntable having an upper polishing surface, at least one carrier for carrying an article with a surface to be polished in such a manner that the surface is engaged with the upper polishing surface of the turntable, and at least one slurry supply nozzle provided for the carrier and adapted to supply a slurry on the polishing surface of the turntable at a predetermined slurry supply point upstream of a line connecting the center axes of the turntable and the carrier in the direction of rotation of the turntable while the turntable and the carrier are rotated around their respective center axes with the surface of the article kept in engagement with the polishing surface. The nozzle is preferably positioned such that an angle is formed between the line connecting the center axis of the turntable and the center axis of the carrier and a line connecting the center axis of the carrier and the predetermined slurry supply point is in the range of from 5 degrees to 40 degrees.

8 Claims, 19 Drawing Sheets

POLISHING APPARATUS AND METHOD

BACKGROUND OF THE INVENTION

The present invention relates to a polishing apparatus and a polishing method which is, in particular, suitable for polishing of a semiconductor wafer.

FIG. 16 shows a typical semiconductor wafer polishing apparatus for conducting a precise polishing process for a semiconductor wafer which process is referred to as "chemical-mechanical planarization" (CMP). The polishing apparatus includes a turntable 100 and two wafer carriers 101, 102 which are respectively rotated around their respective center axes in the directions designated by arrows A, B and C. The turntable is provided, on its top surface, with a polishing pad. Each of the wafer carriers 101, 102 holds a wafer on the bottom surface thereof. The wafer carriers are symmetrically positioned relative to the center axis of the turntable. The apparatus further includes a slurry supply nozzle 104. In operation, wafers carried by the carriers 101, 102 are engaged with the polishing pad on the turntable 100 while the turntable and the wafer carriers 101, 102 are rotated and the slurry supply nozzle 104 continuously supplies a slurry onto the polishing pad. The wafers are polished mechanically and chemically by means of the polishing pad and the slurry. The wafer carriers 101, 102 are swingable in the directions designated by arrows D and E, respectively, to enable the wafers to be mounted on and removed from the wafer carriers.

In such a polishing apparatus, it is desirable that consumption of slurry, which is expensive, be minimized, so far as a high polishing performance in term of polishing rate, evenness of a polished surface of a wafer and so on is maintained. Thus, there is a need to effectively transfer the slurry to the wafers after the slurry is applied to the polishing pad.

SUMMARY OF THE INVENTION

Accordingly, it is an object of the present invention to provide a polishing apparatus and a polishing method which will meet such a need.

In accordance with the present invention, a polishing apparatus comprises a turntable having an upper polishing surface and a center axis about which the turntable is rotated, at least one carrier having a center axis and adapted to carry an article having a surface to be polished in such a manner that the surface is engaged with the upper polishing surface of the turntable, and at least one slurry supply nozzle provided for the carrier and adapted to supply a slurry onto a predetermined slurry supply point on the polishing surface of the turntable upstream of the carrier or upstream of a line connecting the center axes of the turntable and the carrier in the direction of rotation of the turntable while the turntable and the carrier are rotated around their respective center axes with the surface of the article kept in engagement with the polishing surface. The nozzle is preferably positioned such that the angle form between a line connecting the center axis of the turntable and the center axis of the corresponding wafer carrier and a line connecting the center axis of the wafer carrier and the predetermined slurry supply point is in the range of 5 degrees to 40 degrees. The arrangement of the wafer carrier and the nozzle as noted above will enable the slurry supplied on the polishing surface by the nozzle to be effectively transferred to the wafer carrier.

Specifically, the supply nozzle is positioned as represented by $d/R \leqq 0.3$ where d is a distance between the outer peripheral edge of the carrier and the predetermined slurry supply point and R is a radius of the carrier. The above-noted condition will facilitate the effective transfer of the slurry.

The apparatus may comprise a plurality of wafer carriers and corresponding slurry supply nozzles which are symmetrically positioned relative to the center axis of the turntable.

It is preferable for the slurry supply nozzle to be located in such a manner that the lower slurry exit end thereof is positioned within a range of 10.0–20.0 mm above the polishing surface of the turntable.

Further, in accordance with the present invention, there is provided a method for polishing a surface of an article which comprises the steps of turning a turntable having an upper polishing surface around its center axis, holding an article by a carrier, positioning the carrier in such a manner that a surface of the article is engaged with the upper polishing surface of the turntable, rotating the carrier about its center axis, and supplying a slurry onto a predetermined slurry supply point on the polishing surface of the turntable upstream of the carrier or upstream of a line connecting the center axes of the turntable and the carrier in the direction of the rotation of the turntable while rotating the turntable and the carrier around their respective center axes with the surface of the article kept in engagement with the polishing surface. The nozzle is positioned such that the angle formed between a line connecting the center of the rotation of the turntable and the center of the rotation of the carrier and a line connecting the center of the rotation of the carrier and the predetermined slurry supply point is in the range of from 5 degrees to 40 degrees.

The above and other features and advantages of the present invention will become apparent from the following description and the appended claims taken in conjunction with the accompanying drawings.

BRIEF DESCRIPTION OF THE DRAWINGS

FIG. 5(*b*) is a schematic view showing the actual progress of the movement of the slurry on the turntable, FIG. 6(*a*) is a computer-aided analytic view showing, in the shape of a contour map, a state of the distribution of the slurry on the turntable;

FIG. 7 is a composite drawing in which FIG. 6 is overlapped by a figure showing velocity vectors which the slurry supplied on the turntable will be obtained on the turntable;

FIG. 15 is a composite drawing in which FIG. 12 is overlapped by a figure showing velocity vectors which the slurry supplied on the turntable will be obtained on the turntable;

DETAILED DESCRIPTION OF THE INVENTION

Figure 1:
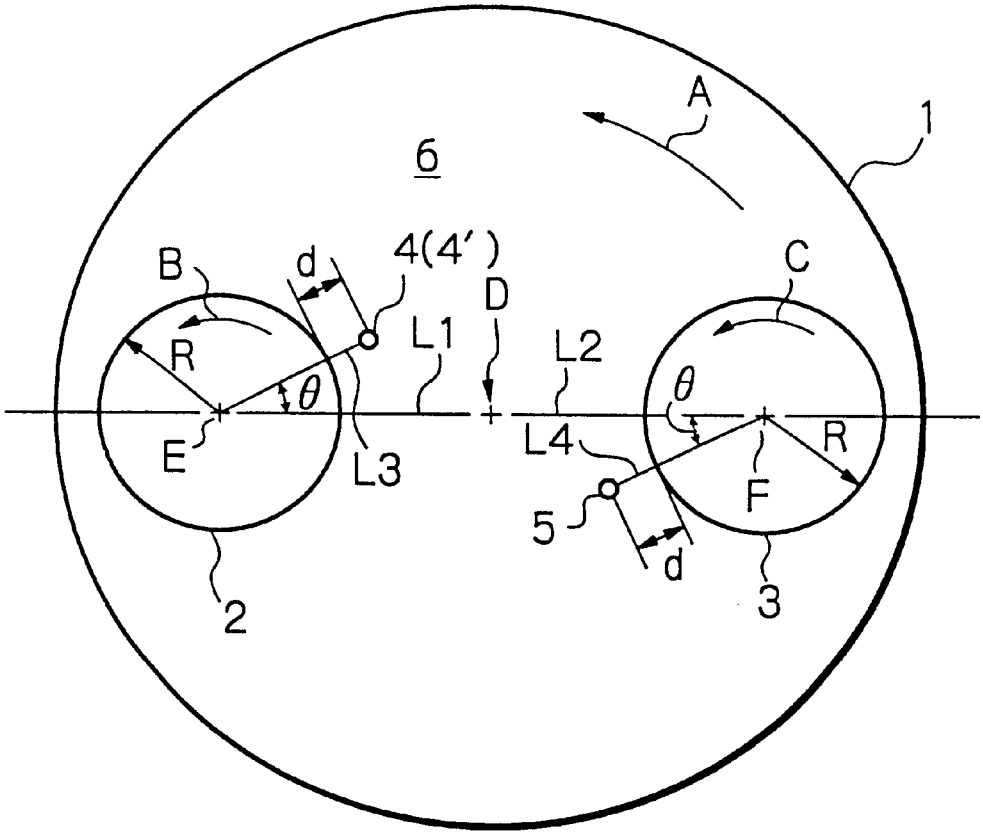
FIG. 1 is a schematic view showing the relationship among a turntable, wafer carriers and slurry supply nozzles in accordance with an embodiment of the present invention.

FIG. 1 shows a relationship among a turntable 1, two wafer carriers 2 and 3 for carrying wafers and slurry supply nozzles 4 and 5 in a wafer polishing apparatus in accordance with an embodiment of the present invention. The turntable 1 and wafer carriers 2 and 3 are respectively rotated about their respective center axes D, E and F in the counter-clockwise direction as designated by arrows A, B and C. As shown, the wafer carriers are positioned symmetrically relative to the center axis D of the turntable or at diametrically opposite positions.

On the top surface of the turntable is provided a polishing pad 6. Wafers are supported on bottom surfaces of the wafer carriers 2 and 3 and are engaged with the polishing pad. The wafers are polished by the polishing pad due to the relative movement between the wafers rotated by the rotating carriers 2 and 3 and the rotating turntable 1. When the wafers are polished, each of the slurry supply nozzles continuously supplies slurry onto the polishing pad 6 at a single geometric slurry supply point as shown in FIG. 1.

As discussed later, as a result of an analysis of slurry flows on the polishing pad, it has been found that the slurry should be supplied in such a manner that the following formula is satisfied:

$$5° \leqq \theta \leqq 40°$$

where θ is an angle formed between a line L1, L2 connecting the center axis D of the turntable 1 and the center axis E, F of the wafer carrier 2, 3 and a line connecting the center axis E, F of the wafer carrier 2, 3 and the slurry supply point 4', 5' on which the slurry is supplied. The slurry supply points 4', 5' are positioned upstream of the corresponding wafer carriers 2 and 3 respectively.

However, it may be possible for the slurry to be placed in a range wider than the above-noted range as long as the slurry is placed upstream of the line connecting the center axis D of the turntable 1 and the center axis E, F of the wafer carrier 2, 3 in the direction of the rotation of the turntable. Although if the slurry supply nozzles 4 and 5 are positioned outside of the range defined by the above-noted formula, a relatively large amount of the slurry supplied onto the polishing pad will remain on the center area of the polishing pad and a relatively large amount of the slurry will move away from the polishing pad without reaching the wafer carriers, as will be explained below. This results in an increase in the amount of slurry waste. Further, it has been found that when the angle "θ" is about 27°, the slurry can be supplied to the wafer carrier with optimum results.

Additionally, it has been found that if the slurry nozzles 4, 5 are positioned as represented by $d/R \leqq 0.3$ where d is a distance between the outer periphery edge of the carrier and the slurry supply point and R is a radius of the carrier the slurry can be supplied more effectively to the wafer carrier.

Further, it has been determined that the distance between the tip ends of the slurry supply nozzles 4 and 5 and the polishing pad should be within 10.0–20.0 mm.

Furthermore, it has been found that the tip or lower ends of the slurry supply nozzles 4 and 5 should be positioned within the range of 10.0–20.0 mm above the upper surface of the polishing pad 6. If the tip ends are positioned outside of the range noted above, it becomes difficult to appropriately control the supply of the slurry onto the polishing pad. It is considered that if the distance between the tip end and the polishing pad is shorter than 10 mm, the slurry will be supplied such that the tip end of the slurry supply nozzle substantially comes into contact with the slurry on the top surface of the polishing pad. Further, if the distance is larger than 20 mm, the slurry supply points 4' and 5' on the surface of the polishing pad tend to move due to various factors, namely the inclination of the nozzles, the flow rate of the slurry and so on.

The above-noted conditions concerning the positioning of the tip end of the slurry supply nozzle have been determined through a computer-aided analysis with respect to flows of slurry supplied on a polishing surface of a turntable of a semiconductor polishing apparatus which is explained hereinbelow.

The analysis was conducted by using an analysis program called "FLUENT" which is used to analyze fluid flows on a free surface. Among various analysis methods for analyzing fluid flows on a free surface, a method called "VOF method" was used. The "VOF" is an acronym of "Volume of Fluid". In this method, an imaginary analysis surface which is divided into a number of small segments and volumes of fluid (VF) on the respective segments of the analysis surface which fluid is assumed to flow on the analysis surface are calculated. A state of a distribution of the fluid on the surface is prepared on the basis of the values of the VF.

Figure 2:
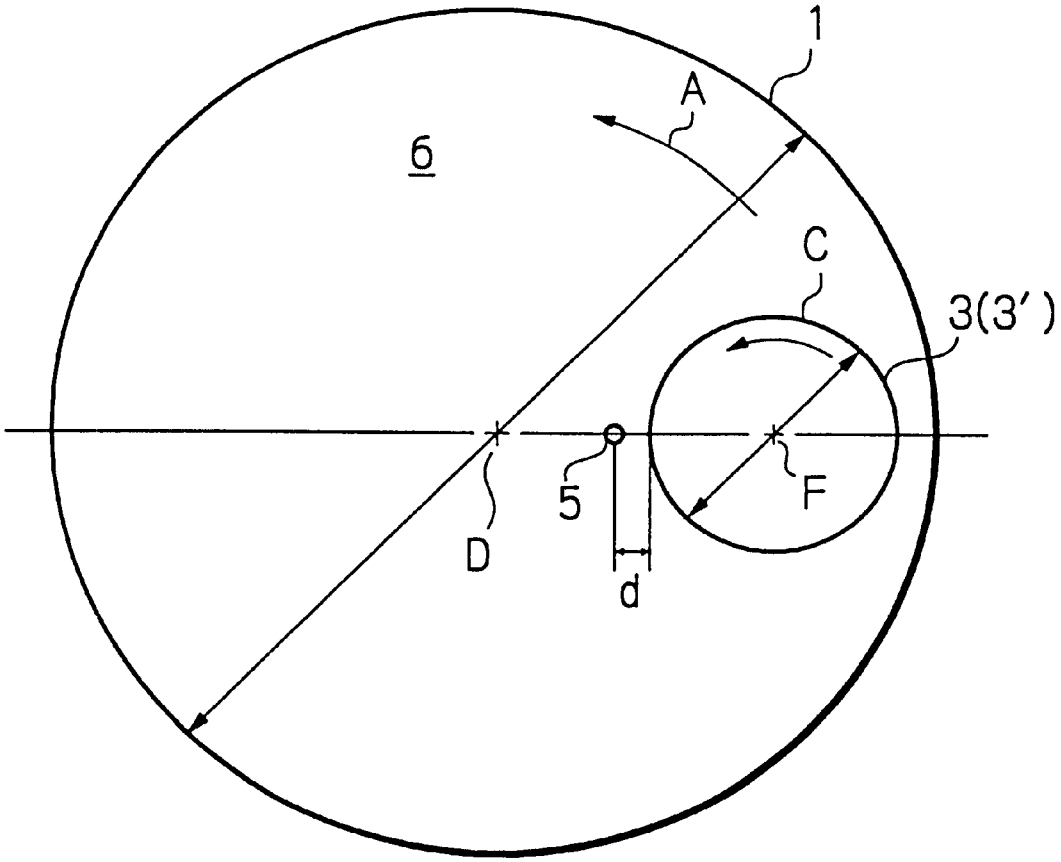
FIG. 2 is a schematic view showing a relationship among a turntable, a wafer carrier and a slurry supply nozzle which was used to conduct a computer-aided analysis with respect to slurry flow supplied onto the turntable in connection with the present invention.
Figure 3:
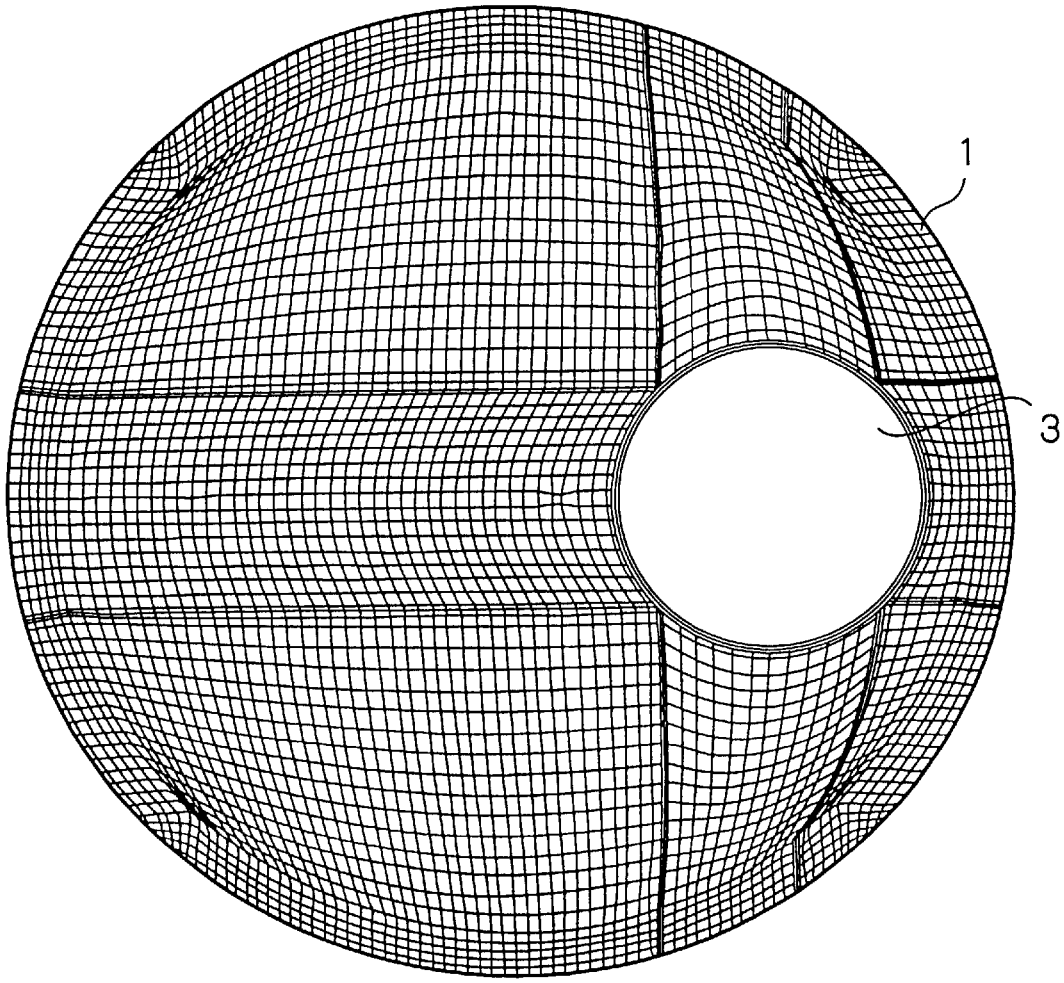
FIG. 3 is an analysis surface corresponding to the turntable in FIG. 2 which is divided into a number of surface segments and was used to conduct the computer-aided analysis noted above.
Figure 4:
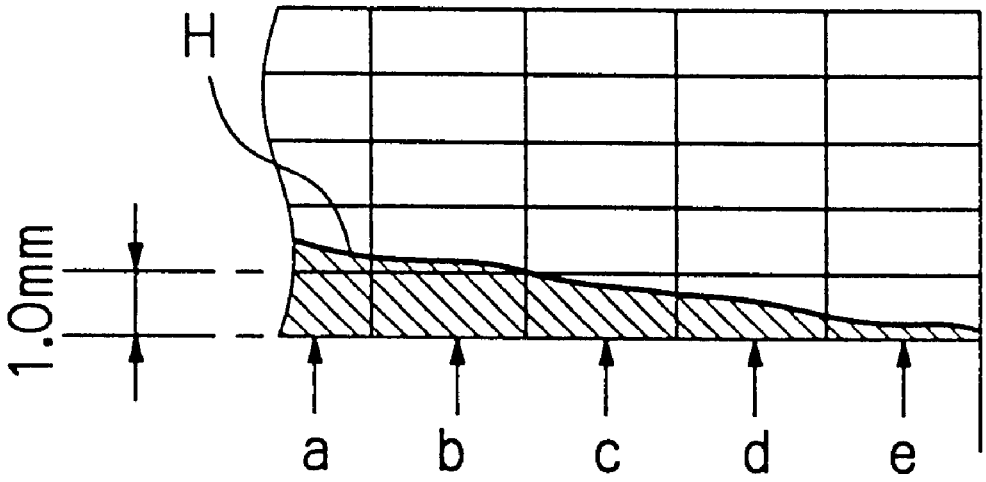
FIG. 4 is a cross sectional side elevation view of a slurry on a portion of the analysis surface.

FIG. 2 shows a single wafer carrier positioned relative to the turntable 1 used in the analysis. The turntable 1 has a diameter of 600 mm and the wafer carrier 3 has a diameter of 200 mm. It is presumed that the outer peripheral edge 3' of the bottom surface of the carrier substantially contacts the polishing surface of the polishing pad 6 provided on the top surface of the turntable 1. The lower tip end of a slurry supply nozzle 5 is spaced away from the peripheral edge 3' of the wafer carrier 3 by 10 mm. FIG. 3 shows the analysis surface as stated above prepared corresponding to the turntable shown in FIG. 2. FIG. 4 is a cross sectional view of a slurry flowing on surface segments a–e of the analysis surface.

In FIG. 4, a vertical scale including 1 mm divisions is applied to show height of the slurry. The analysis is effected on the basis of a presumption that slurry segments on the respective surface segments of the analysis surface are not separated from adjacent ones. Values of the VF on the respective surface segments indicate the height of the slurry on the respective surface segments. In FIG. 4, the values of the VF on the surface segments a, b, c, d and e are 1.0, 1.0, 0.9, 0.5 and 0.15, respectively.

Figure 5B:
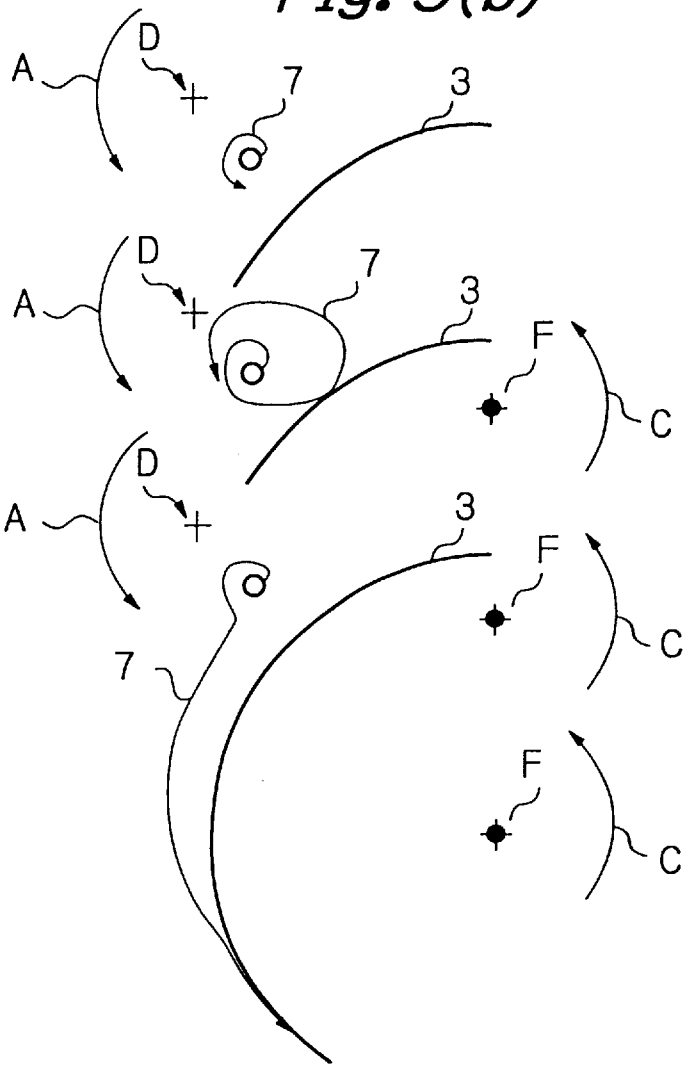
FIG. 5(*a*) is a schematic view showing traces of slurry flows prepared on the basis of the computer-aided analysis.
Figure 5A:
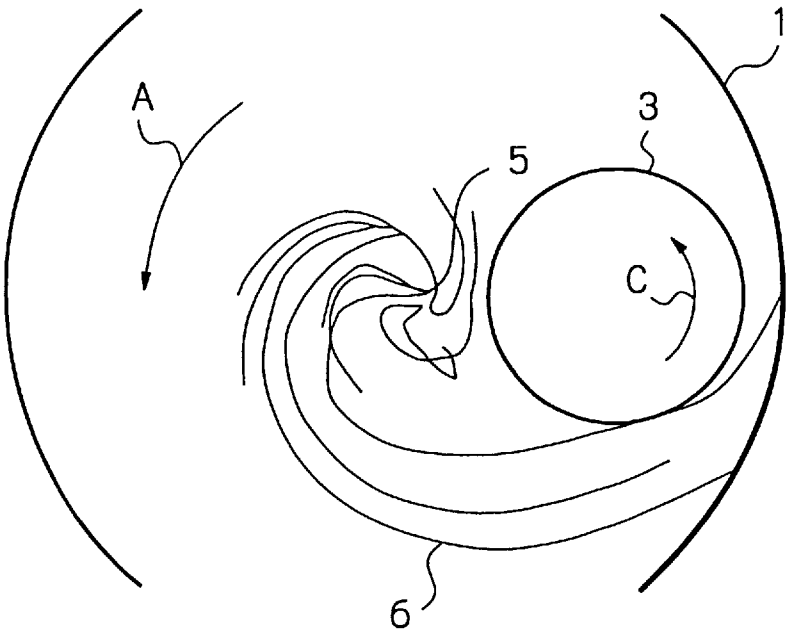

FIG. 5(*a*) shows a result of the analysis showing traces 6 of flows of slurry supplied on the polishing pad by the nozzle 5. FIG. 5(*b*) is a result of a test showing a progress of a movement of particles of expanded polystyrene contained in a slurry supplied on the polishing pad from the nozzles. The progress was observed by taking photos of a flow of the slurry 7. As noticed from those figures, the slurry flow 7 first moves about the slurry supply point 5' on the polishing pad in response to the rotation of the turntable and finally reaches the wafer carrier 3.

Figure 6A:
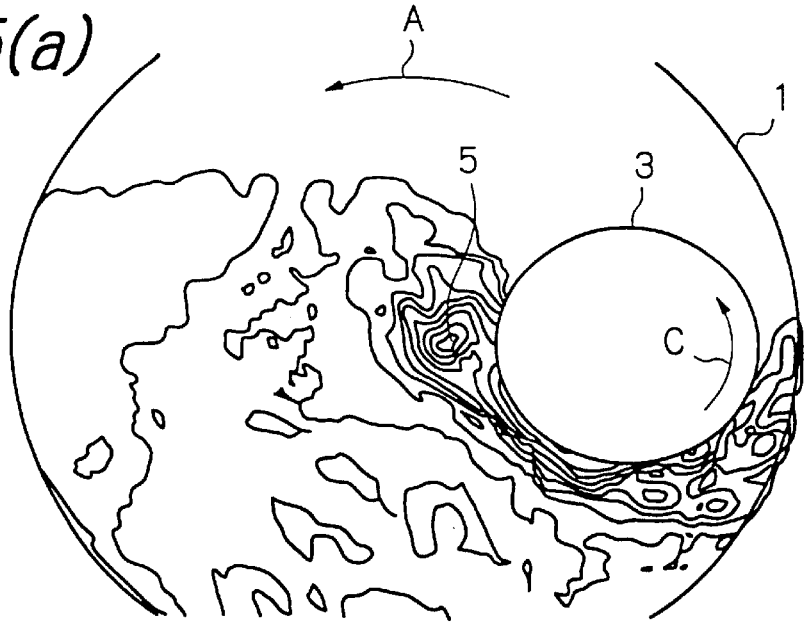
FIG. 6(*b*) is a composite view showing the movement of the slurry prepared on the basis of a plurality of photos of the slurry flow taken at a predetermined time interval.
Figure 6B:
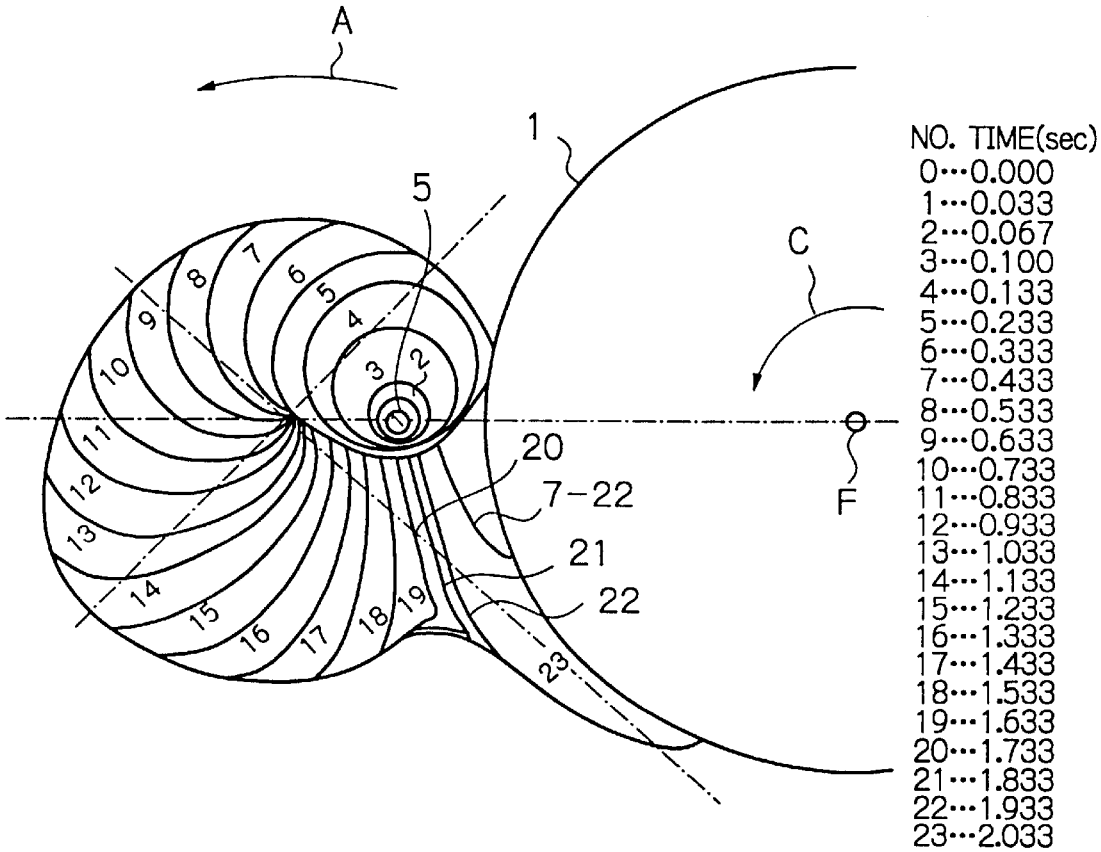

FIG. 6(*a*) is an analytical view prepared on the basis of values of the VF showing contour lines of a slurry distributed on the polishing pad 10 minutes after the supply of the slurry in which the values of the VF ranges from 0.0–0.5. As noticed from the contour map, an area on the polishing pad downstream of the wafer carrier 3 bears substantially no slurry and there is a thick layer area of the slurry around the periphery of the wafer carrier ranging from about the 5 o'clock point to about the 10 o'clock point of the wafer carrier as viewed in FIG. 6(*a*). FIG. 6(*b*) is a view prepared on the basis of a plurality of photos of the slurry supplied onto the polishing pad through the nozzle 5 which photos were taken at predetermined time intervals of about 0.033 second.

In FIG. 6(*b*), the numerals noted on the successive figures of the slurry represent the sequence of photos. On the right-side of FIG. 6(*b*) are noted times at which the photos were taken and which were measured from a time at which the slurry was initially supplied. It should be noted that there is a thick layer of slurry in the area ranging from about the 7 o'clock point to about the 10 o'clock point of the wafer carrier. This generally coincides with that shown in FIG. 6(*a*). In this case, the turntable 1 and the wafer carrier 3 were rotated about their respective center axes in a counterclockwise direction designated by arrows A and C. The rotation rates of the turntable 1 and the wafer carrier 3 were 35 rpm and 25 rpm, respectively.

Figure 7:
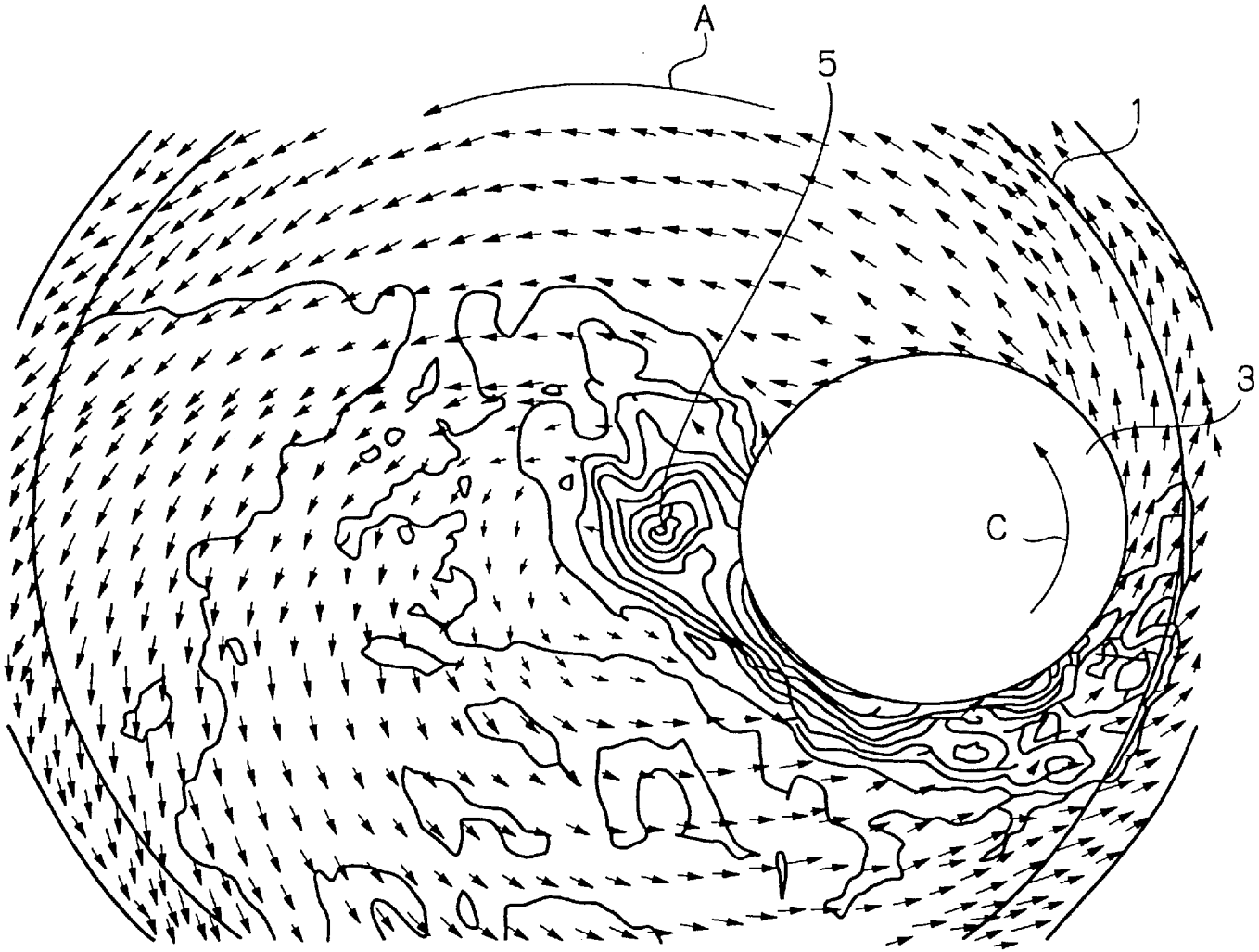

FIG. 7 is a composite drawing prepared by overlapping a figure showing velocity vectors which the slurry might obtain on the polishing pad on the assumption that the slurry supplied by the nozzle 5 is spread over the polishing surface on FIG. 6(*a*). A velocity vector is determined by a combination of a velocity vector of a slurry spreading radially from the slurry supply point and a velocity vector of the slurry obtained from the rotating polishing surface. From FIGS. 6(*a*), 6(*b*) and 7, it is noted that the traces of the flow of the slurry are parallel to the directions of the vectors. This proves that the computer-aided analysis precisely indicates the progress of the flow of the slurry on the polishing surface.

Figure 8:
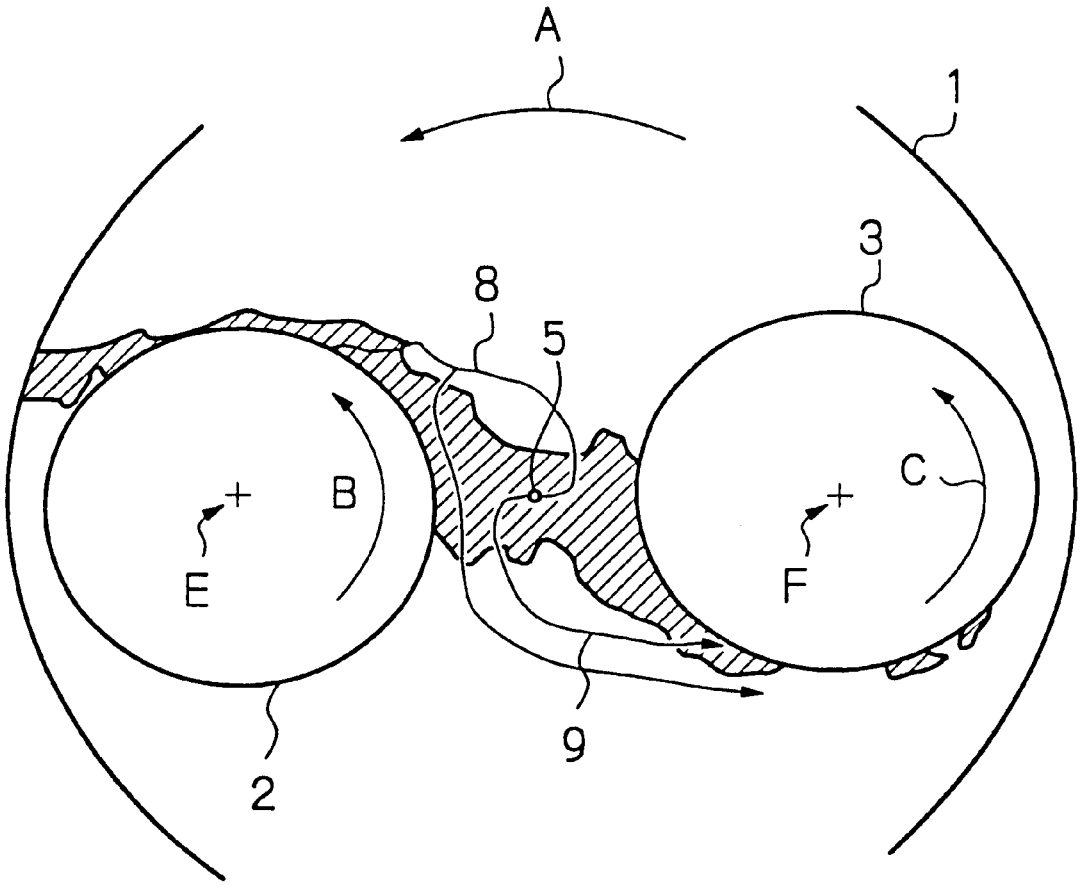
FIG. 8 is a schematic view showing a state of the distribution of the slurry and traces of flows of some parts of the slurry on a turntable with two carriers and a single nozzle arranged with respect to the turntable.

FIG. 8 is a schematic view showing a state of distribution of a slurry supplied on the polishing surface 1 and flow traces 8 and 9 of some portions of the same in a case where two wafer carriers 2 and 3 are provided and a single nozzle 5 is positioned on the line connecting the centers of the wafer carriers 2 and 3 are depicted. The hatching area shows the distributed slurry, the VF values of which are more than 0.45. In this case, an amount of the slurry supplied onto the polishing surface was the same as that in the case shown in FIG. 6(*a*) wherein one wafer carrier is used.

From those figures, it is noted that the locations of thick layer areas of the slurry relative to the wafer carriers 2 and 3 in the case of FIG. 8 are the same as that relative to the wafer carrier 3 in FIG. 6(*a*). It can, therefore, be understood that, in the polishing operation shown in FIG. 8, the slurry is more effectively used than that in FIG. 6(*a*), and this is because in the former operation, an amount of the slurry trapped in the thick layer areas is substantially the same as that in the latter operation whereas in the former case two wafers can be polished at one time.

Figure 9:
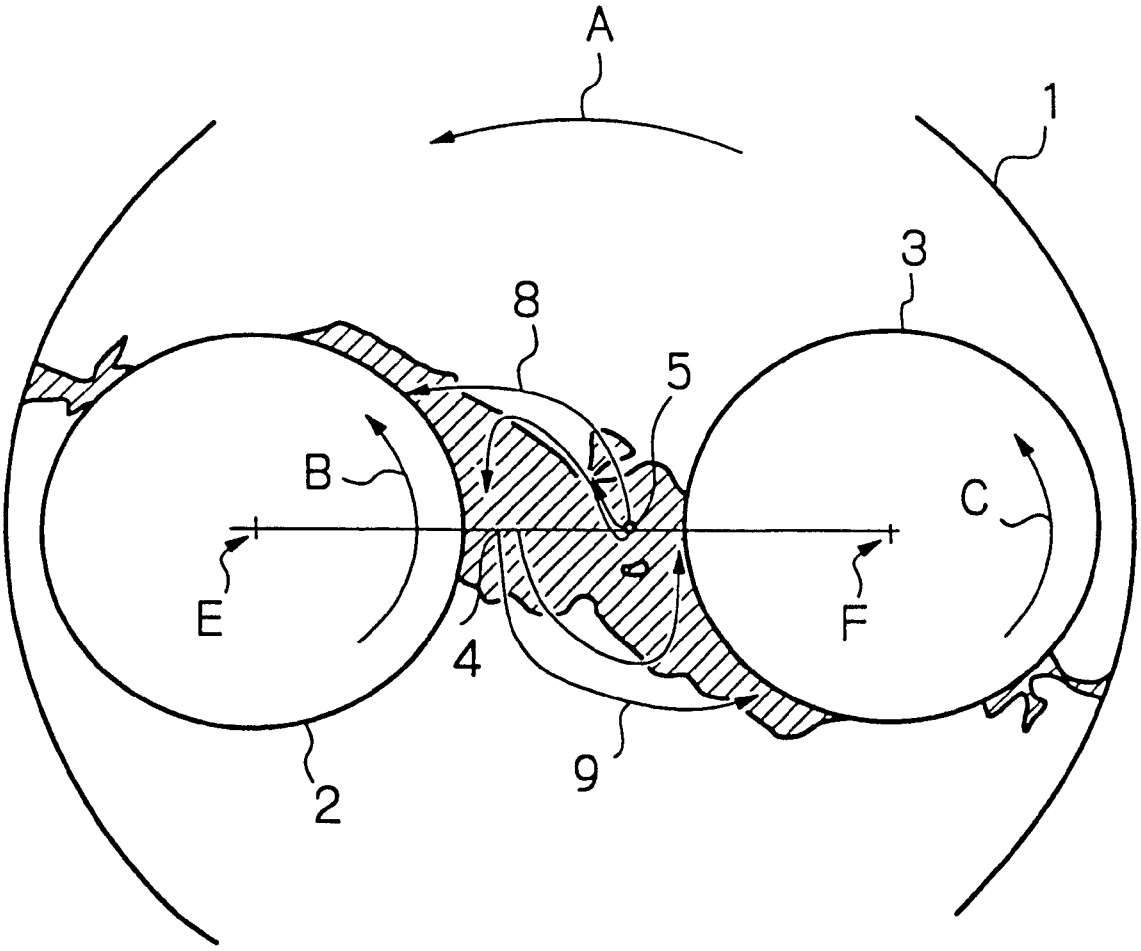
FIG. 9 is a schematic view showing a state of the distribution of the slurry and the traces of flows of some parts of the slurry on a turntable with two carriers and two nozzles arranged with respect to the turntable.

As such, the computer-aided analysis was further conducted with respect to the polishing operation wherein two wafer carriers are used as follows:

FIG. 9 is a drawing similar to FIG. 8 except that two slurry supply nozzles 4 and 5 are provided on a line connecting the center axes of the wafer carriers 2 and 3, and thus the distributed state and traces 8 and 9 of the slurry are different from those in FIG. 8.

Figure 10:
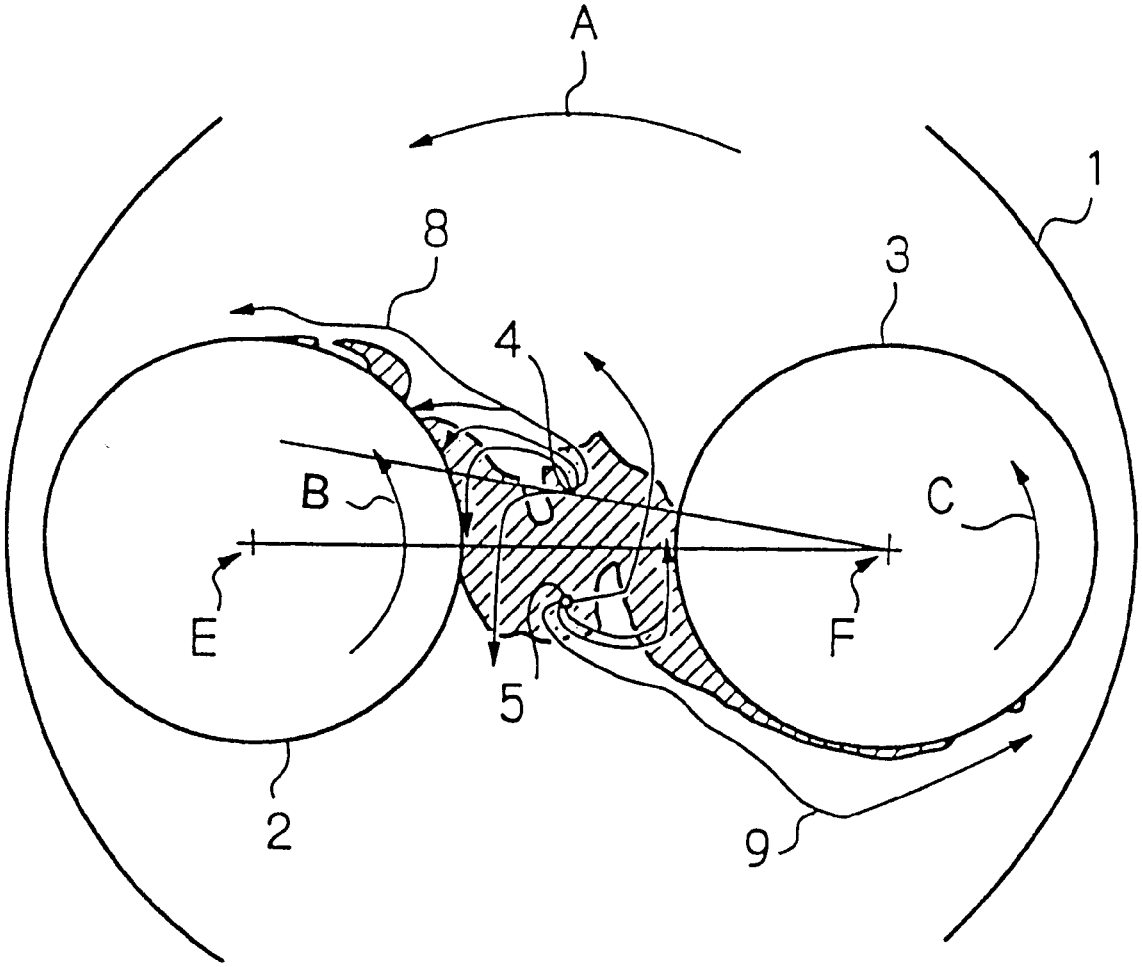
FIG. 10 is a schematic view showing a state of the distribution of the slurry and the traces of flows of some parts of the slurry on a turntable with two carriers and two nozzles arranged with respect to the turntable differently in relation to the arrangement shown in FIG. 9.

FIG. 10 is a view similar to FIG. 9 except for the two slurry supply nozzles 4 and 5 are positioned symmetrically relative to the center of the polishing surface 1 and upstream of the corresponding wafer carriers 2 and 3 in the direction of the rotation of the turntable or polishing pad.

From FIGS. 9 and 10, it is noticed that the polishing pad 1 in FIG. 9 holds a larger thick layer area of the slurry at the center area thereof than the polishing pad in FIG. 10. Namely, when the nozzles 4 and 5 are positioned on the line connecting the centers of the wafer carriers, it is considered that much more slurry remains on the center area of the polishing pad. Furthermore, reviewing the flow traces 8 and 9, it is noted that in FIG. 10, the slurry supplied on the polishing pad 1 by nozzles 4 and 5 flow relatively directly towards the corresponding wafer carriers 2 and 3 positioned downstream of the corresponding nozzles 4 and 5, while in FIG. 9, the slurries supplied on the polishing pad 1 by nozzles 4 and 5 flow in directly towards the corresponding wafer carriers positioned downstream thereof. Accordingly, it can be understood that in the case shown in FIG. 9, a relatively large amount of the slurry supplied on the polishing pad 1 is apt to move radially and outwardly, but is not effectively utilized.

It is therefore realized that the slurry is effectively used by locating the slurry supply nozzle upstream of the corresponding wafer carrier such that an angle θ is formed between the line connecting the center axis of the wafer carrier and the center axis of the turntable and the line connecting the center axis of the wafer carrier and the point where the slurry is supplied by the corresponding nozzle positioned upstream of the corresponding wafer carrier.

Figure 11:
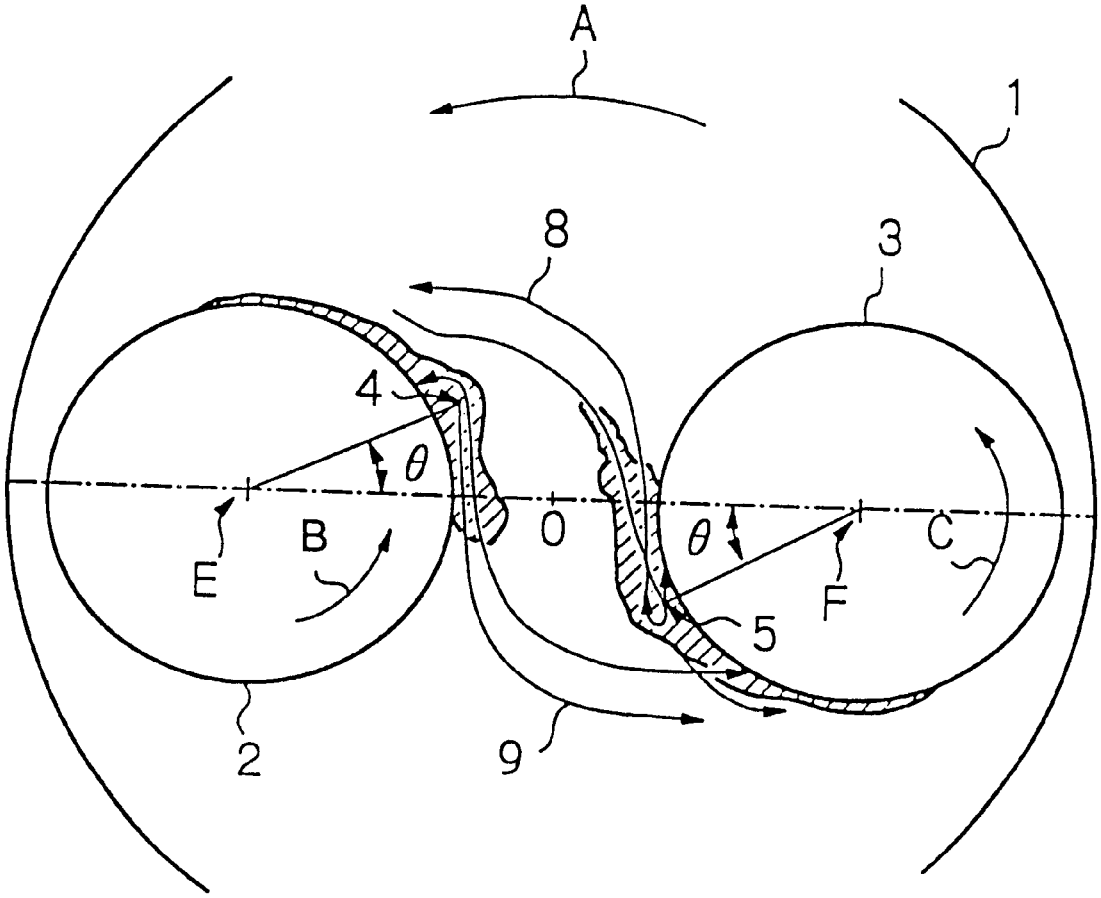
FIG. 11 is a schematic view showing a state of the distribution of the slurry and the traces of flows of some parts of the slurry on a turntable with two carriers and two nozzles arranged with respect to the turntable differently in relation to the arrangements shown in FIG. 9 and 10.

FIG. 11 is a view similar to FIG. 10 except that a distance d between the peripheral edges of the wafer carrier 2, 3 and the slurry supply point 4, 5 is smaller than that in FIG. 10. In this particular case, the distance d was determined to satisfy the formula of $d/R \approx 0.15$ where "R" is a radius of the wafer carriers. As can be seen, in this case, no thick layer of the slurry appears on the center area of the polishing pad. Accordingly, it is noted that the slurry supplied on the polishing surface is more effectively used as compared with other cases stated above.

Figure 12:
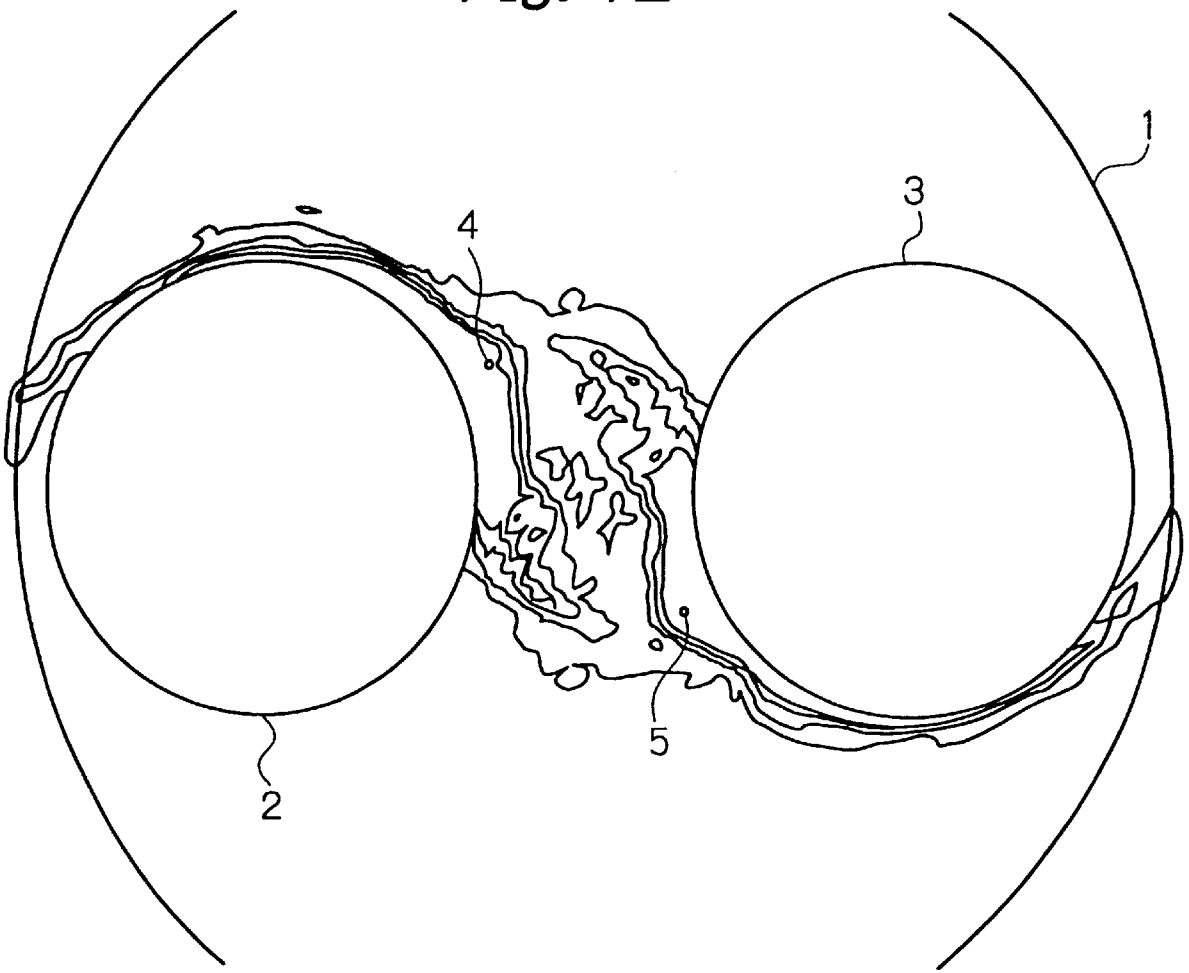
FIG. 12 is a computer-aided analytic view showing a state of the distribution of the slurry on the turn table of FIG. 11 in the form of a contour map, FIG. 11 being prepared on the basis of FIG. 12.
Figure 13:
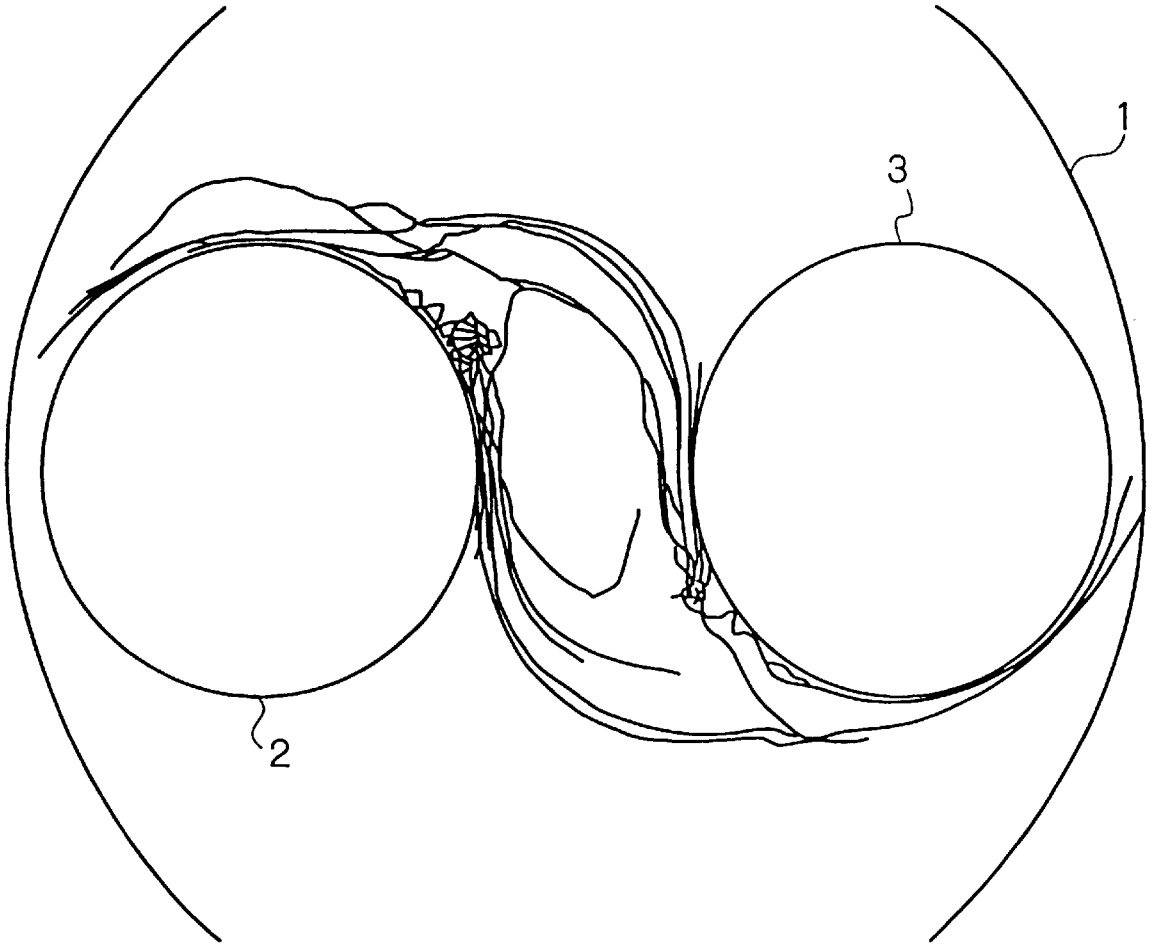
FIG. 13 is a schematic view showing traces of flows of the slurry supplied on the turntable of FIG. 11.
Figure 14:
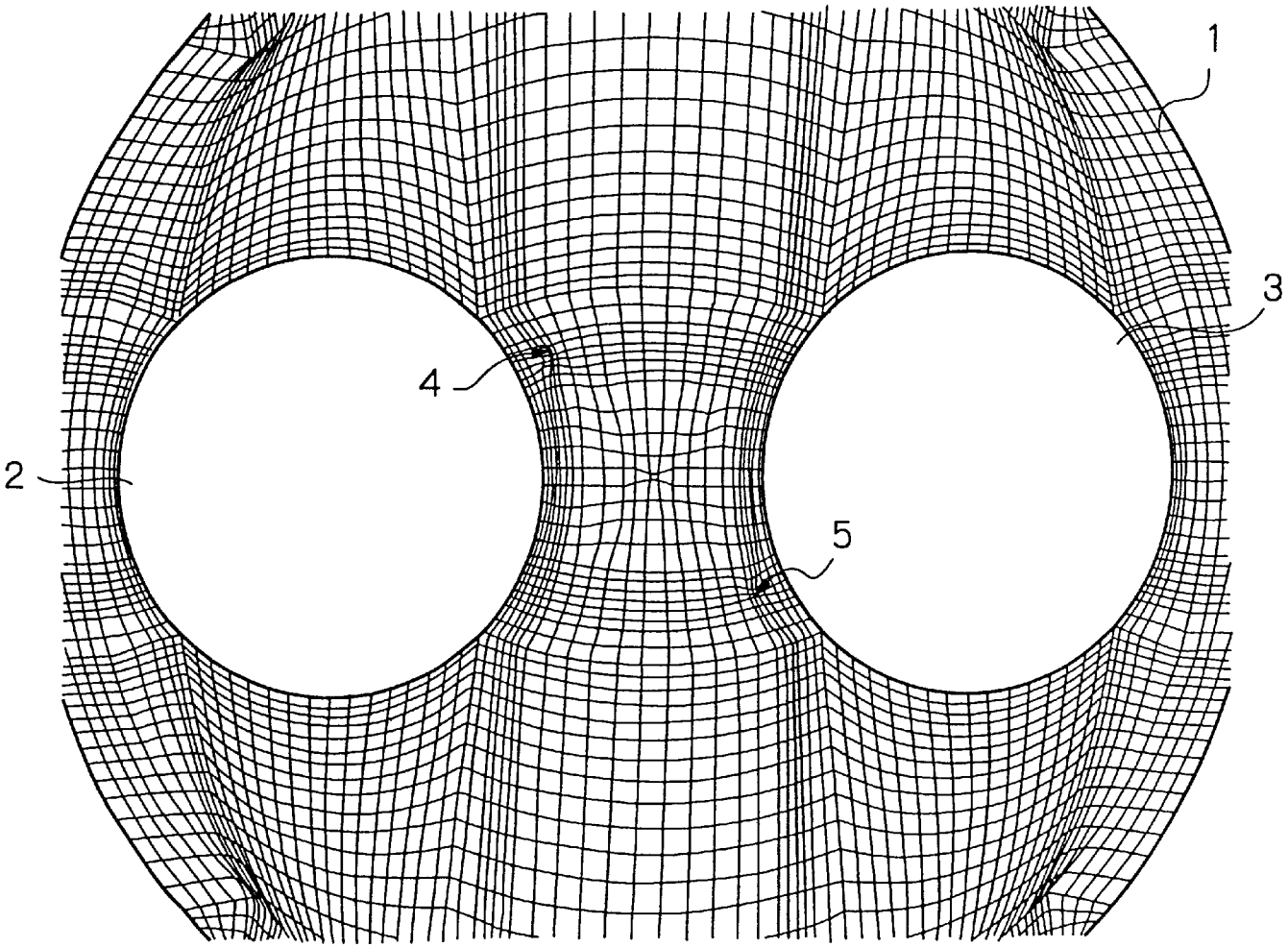
FIG. 14 is an analysis surface corresponding to the turntable in FIG. 11 which is divided into a number of surface segments and was used to conduct the computer-aided analysis noted above.
Figure 15:
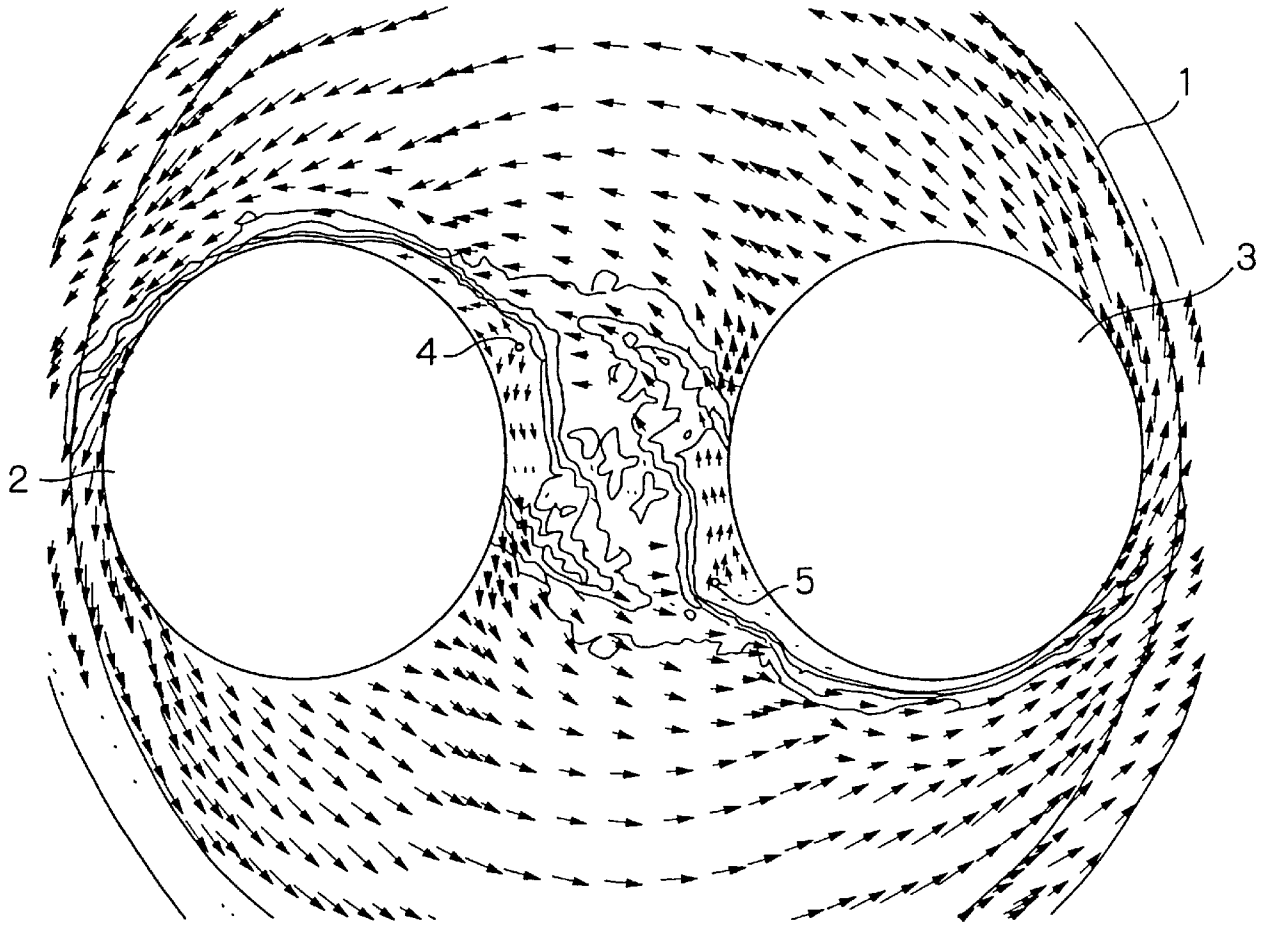
Figure 16:
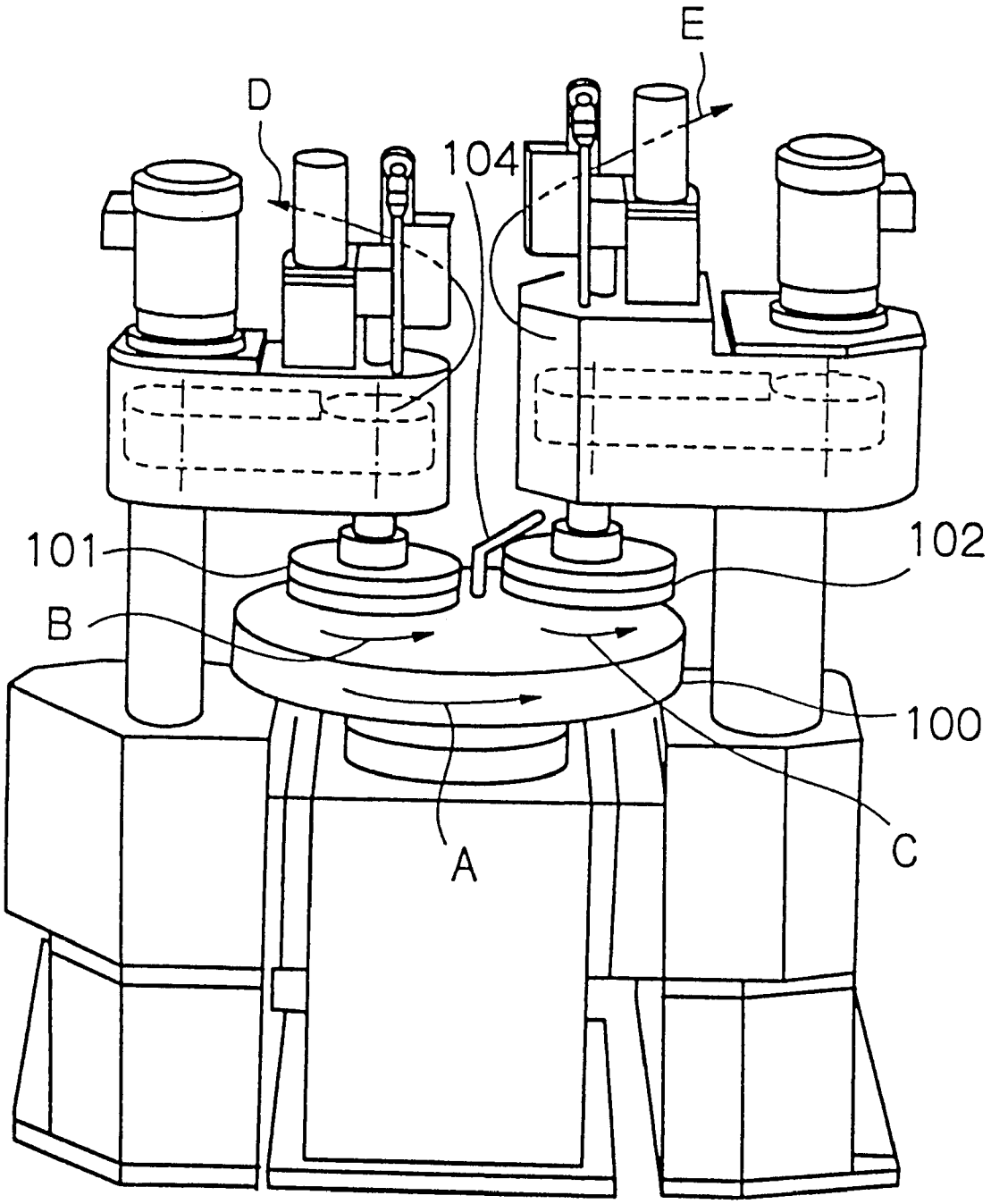
Fig. 16 (PRIOR ART)
FIG. 16 is a perspective view of a polishing apparatus for conducting a CMP process.

FIG. 12 is a computer-aided analysis drawing on the basis of which FIG. 11 was prepared. FIG. 12 shows VF values of the slurry distributed on the polishing pad 1 in the form of a contour map based on an assumption that the wafer carriers 2 and 3 and the nozzles 4 and 5 are positioned as shown in FIG. 11. FIG. 13 is a schematic view showing the traces of flows of a slurry observed when the slurry was supplied onto the polishing pad 1 with the wafer carriers 2 and 3 and the nozzles 4 and 5 positioned as shown in FIG. 11. FIG. 14 is an analytic surface similar to that of FIG. 3 and applied to the polishing surface for conducting the computer-aided analysis with respect to the case as shown in FIGS. 11 and 12. FIG. 15 is a composite drawing in which a figure showing velocity vectors of the slurry on the polishing pad is overlapped on FIG. 12.

As a result of the computer-aided analysis, it has been found that when the nozzles 4 and 5 are positioned in such a manner that $\theta$ is about 27° and d/R is about 0.15, the slurry is most effectively used with a minimum waste thereof and that when $\theta$ is within a range of from 5° to 40°, such a preferable condition is maintained. Further, it is noted that it is more preferable to satisfy the condition of $d/R \leqq 0.3$ in addition to the angle condition just noted above.

Figure 17:
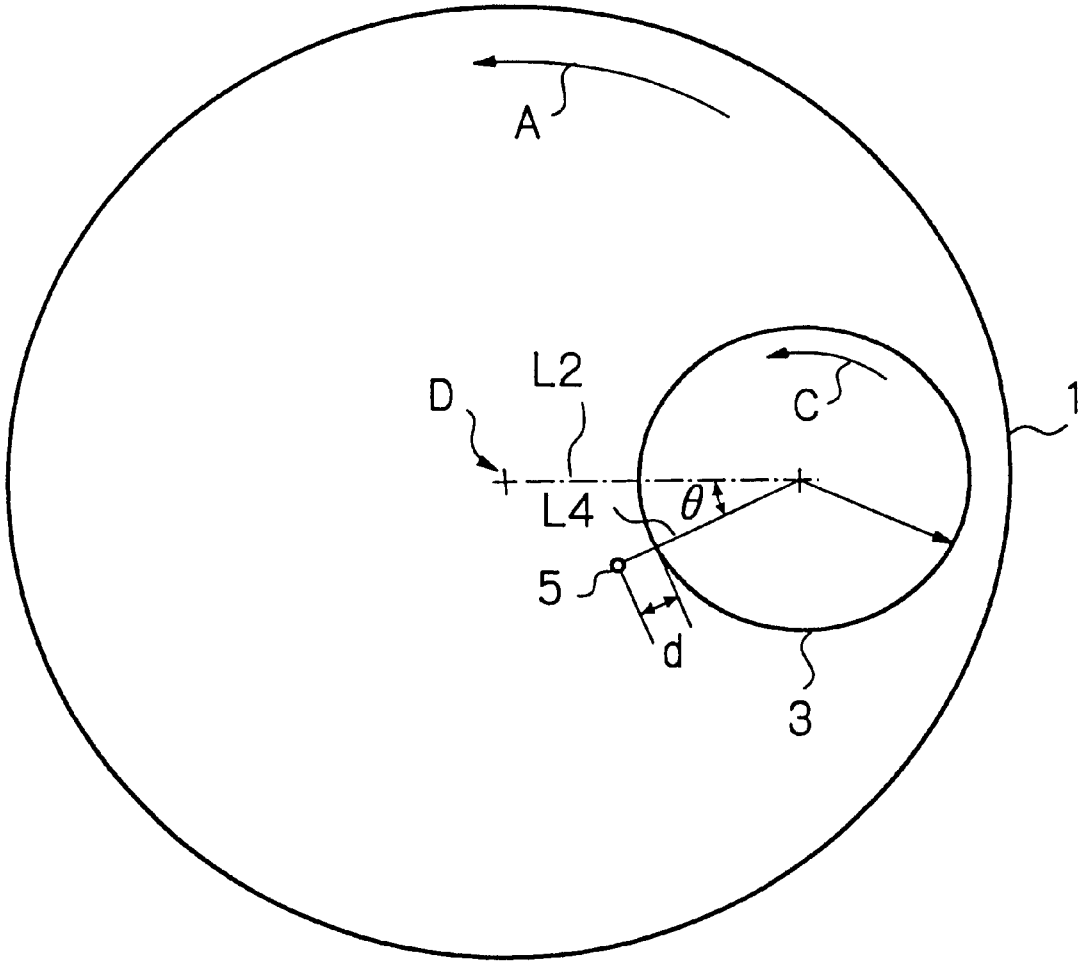
FIG. 17 is a schematic view showing a turntable with a single wafer carrier and a single nozzle arranged in accordance with the present invention.

It should be noted that the above noted conditions with respect to the positioning of the nozzle can apply to a polishing apparatus with a single wafer carrier and a single nozzle. In FIG. 17, if a nozzle 5 is positioned upstream of a wafer carrier 3 in such a manner that an angle $\theta$ between a line L2 connecting the center D of the turntable 1 and the center F of the wafer carrier 3 and a line L4 connecting the center F of the wafer carrier and the tip end of the nozzle 5 is set within the range from 5° to 40°, the slurry supplied onto the polishing pad through the nozzle is effectively used with a little waste of the slurry. In addition, if d/R is equal to or less than 0.3, the slurry is more effectively used.

Figure 18:
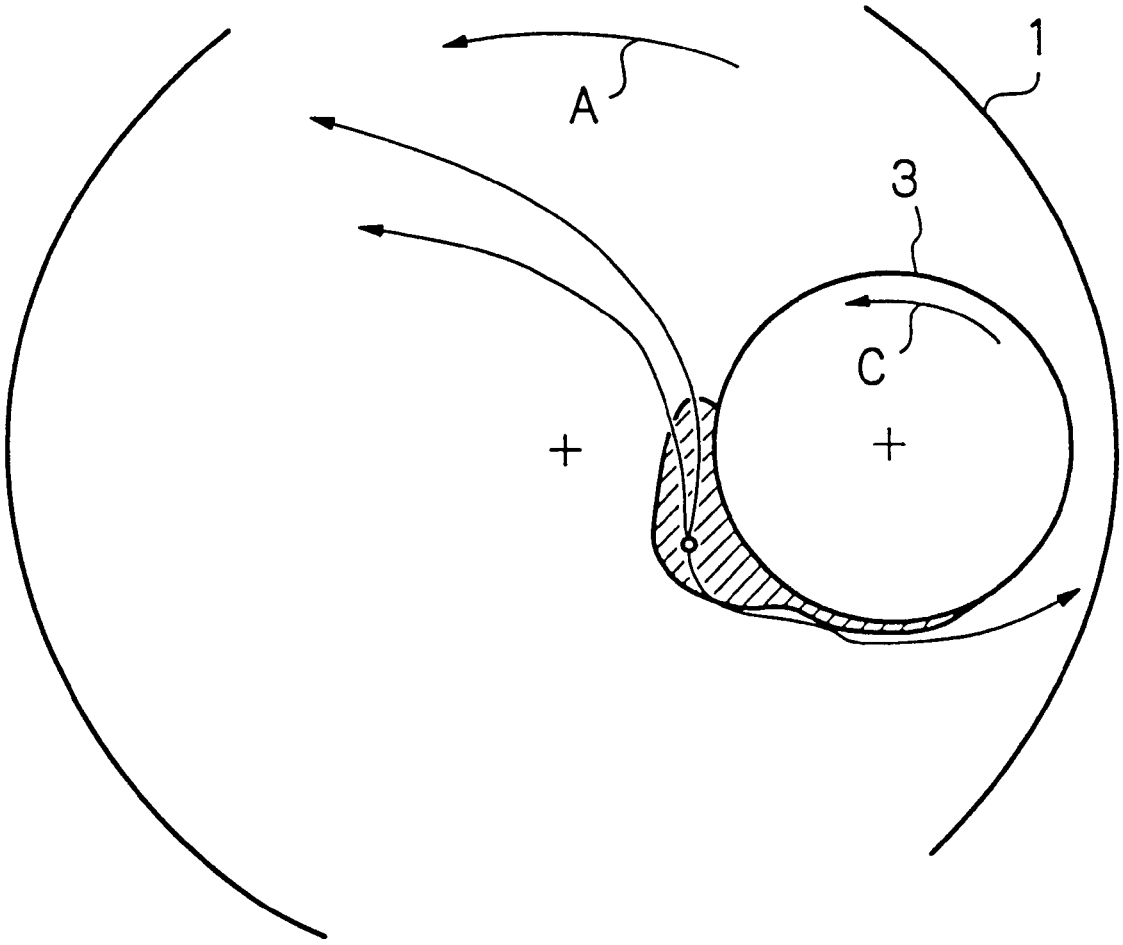
FIG. 18 is a schematic view showing a state of the distribution of the slurry and the traces of flows of some parts of the slurry on the turntable of FIG. 17.

FIG. 18 is a schematic view showing a state of distribution of the slurry and traces of flows of the slurry on the polishing pad as shown in FIG. 17. In FIG. 18, $\theta$ is about 27° and d/R is about 0.15. The area with the hatching shows distributed slurry, the VF value of which is more than 0.45.

Figure 19:
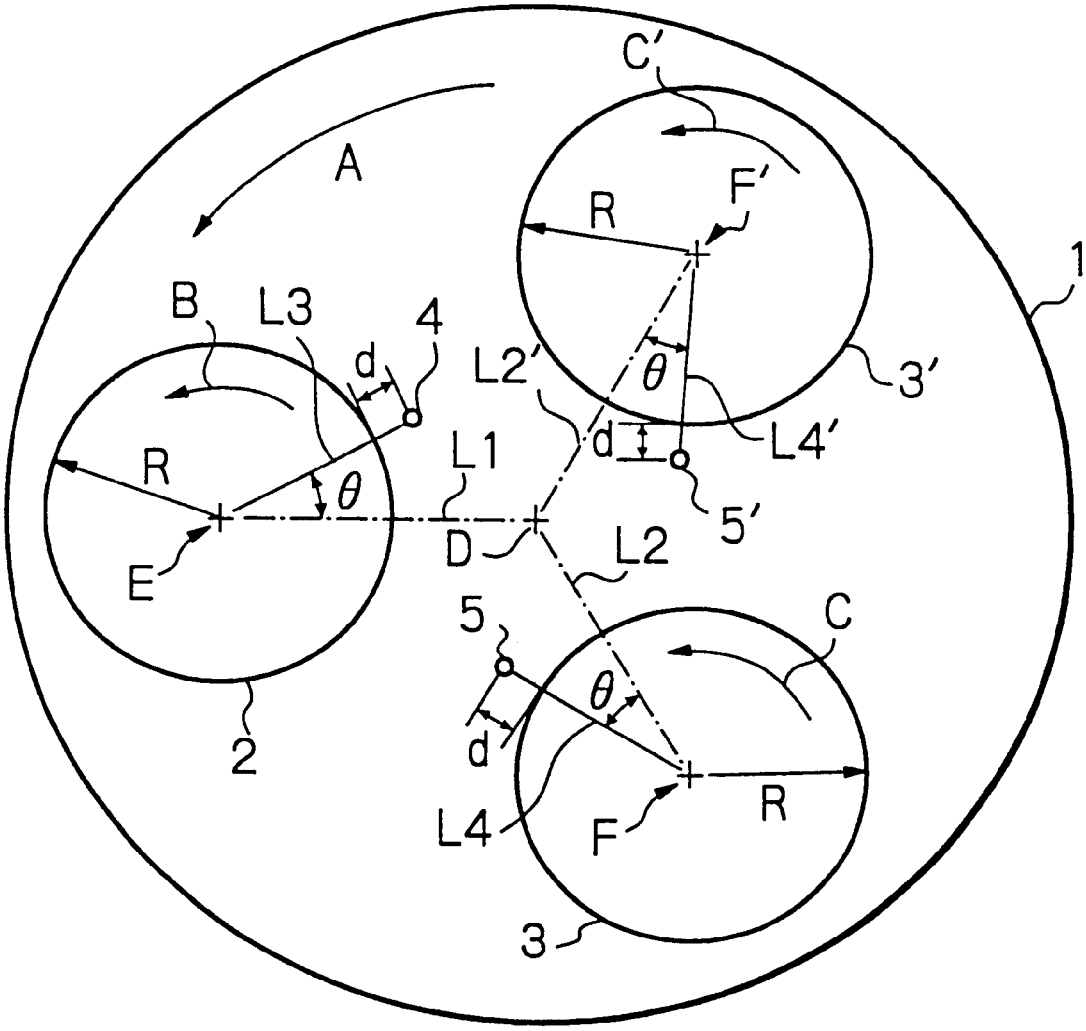
FIG. 19 is a schematic view showing a turntable with three wafer carriers and corresponding nozzles arranged in accordance with the present invention.

Further, the above noted conditions with respect to the positioning of the nozzle stated above can apply to a polishing apparatus having more than two wafer carriers and a corresponding number of nozzles. FIG. 19 shows such a case wherein three wafer carriers 2, 3 and 3' and three slurry supply nozzles 4, 5 and 5', positioned upstream of the corresponding wafer carriers 2, 3 and 3', are provided. As in the other cases stated above, by satisfying the formula, i.e., $5° \leqq \theta \leqq 40°$ or, preferably, $5° \leqq \theta \leqq 40°$ and $d/R \leqq 0.3$, the slurry supplied through the nozzles 4, 5 and 5' onto the polishing surface 1 is effectively used.

In summary, according to the present invention, it is preferable for a nozzle or nozzles to be positioned so as to be offset from a center axis of a turntable and upstream of a wafer carrier or corresponding wafer carriers in such a manner that the formula, i.e., $5° \leqq \theta \leqq 40°$ or, more preferably, $5° \leqq \theta \leqq 40°$ and $d/R \leqq 0.3$ is satisfied. Thereby, the whereby the slurry supplied onto the polishing surface by the nozzle is effectively used with a minimum waste of the slurry to thereby reduce the running costs of the polishing apparatus.

Further, it is preferable for the nozzle to be positioned in such a manner that the tip end of the nozzle is positioned within a range of 10.00 mm–20.00 mm above the polishing so that the slurry is precisely and appropriately supplied on a predetermined position on the polishing surface.

What is claimed is:

1. A polishing apparatus comprising:

a turntable having an upper polishing surface;

one or more carriers each for carrying an article to be polished such that a surface of the article is polished when the surface of the article is engaged with the upper polishing surface of said turntable; and one or more slurry supply nozzles each provided for supplying a slurry on the polishing surface of said turntable at only a predetermined single geometric slurry supply point located upstream of a corresponding one of said carriers with respect to a direction of rotation of said turntable while said turntable and said carrier are rotated about their respective center axes with the surface of the article being kept in engagement with the upper polishing surface of said turntable, said nozzle being positioned such that an angle, in a range of from 5 degrees to 40 degrees, is formed between a line connecting the center axis of said turntable and the center axis of said corresponding carrier, and a line connecting the center axis of the carrier and the predetermined slurry supply point.

2. A polishing apparatus as claimed in claim 1, wherein said slurry supply nozzle has a lower slurry exit end that is positioned within a range of 10.0 to 20.0 mm above the upper polishing surface of said turntable.

3. A polishing apparatus as claimed in claim 1, wherein said slurry supply nozzle is positioned such that d/R is less than 0.3, where d is a distance between an outer peripheral edge of said carrier and the predetermined slurry supply point and R is a radius of said carrier.

4. A polishing apparatus as claimed in claim 2, wherein said slurry supply nozzle has a lower slurry exit end that is positioned within a range of 10.0 to 20.0 mm above the upper polishing surface of said turntable.

5. A polishing apparatus comprising:

a turntable having a polishing surface;

a plurality of wafer carriers for holding articles to be polished in engagement with the polishing surface of said turntable; and a plurality of slurry supply nozzles corresponding to said plurality of wafer carriers, respectively, wherein each of said slurry supply nozzles is positioned, relative to said corresponding wafer carrier, to supply a slurry on the polishing surface of said turntable at only a predetermined single geometric slurry supply point located upstream of said corresponding wafer carrier with respect to a direction of rotation of said turntable while said turntable and said corresponding wafer carrier are rotated about their respective center axes with the surface of the article being held in engagement with the polishing surface of said turntable, each of said nozzles being positioned such that an angle is formed between a line connecting the center axis of said turntable and the center axis of said corresponding carrier, and a line connecting the center axis of the corresponding carrier and the predetermined slurry supply point, wherein the angle is in a range of from 5 degrees to 40 degrees, wherein said wafer carriers and said corresponding slurry supply nozzles are arranged in a circumferentially equally spaced relationship.

6. A polishing apparatus as claimed in claim 5, wherein said slurry supply nozzle is positioned such that d/R is less than 0.3, where d is a distance between an outer peripheral edge of said carrier and the predetermined slurry supply point and R is a radius of said carrier.

7. A polishing apparatus comprising:

a turntable having an upper polishing surface;

a plurality of carriers, each for carrying an article with a surface to be polished in such a manner that the surface is engaged with the upper polishing surface of said turntable; and a plurality of slurry supply nozzles corresponding to said plurality of carriers, respectively, each of said slurry supply nozzles being adapted to supply slurry on the upper polishing surface of said turntable at only a predetermined single geometric slurry supply point that is located upstream of a line connecting the center axis of said turntable and the center axis of said corresponding carrier and downstream of the carrier that is next to and upstream of the corresponding carrier with respect to the direction of rotation of said turntable while said turntable and said carriers are rotated around their respective center axes with the surface of the article kept in engagement with the upper polishing surface of said turntable.

8. A method of polishing a surface of an article the method comprising:

turning a turntable having an upper polishing surface;

holding an article by a carrier having a center axis;

positioning the carrier in such a manner that a surface of the article is engaged with the upper polishing surface of the turntable;

rotating the carrier about its central axis; and supplying a slurry to only a predetermined single geometric slurry supply point on the polishing surface of the turntable, the slurry supply point being upstream of the carrier with respect to the direction of rotation of the turntable while the turntable and the carrier are respectively rotated around their respective central axes with the surface of the article held in engagement with the upper polishing surface of the turntable, wherein the nozzle is positioned so that an angle is formed between a line connecting the central axis of the turntable and the central axis of the carrier, and a line connecting the central axis of the carrier and the predetermined slurry supply point, and the angle is in the range of 5 degrees to 40 degrees.

* * * * *